US007159801B2

(12) United States Patent
Catasus-Servia

(10) Patent No.: US 7,159,801 B2
(45) Date of Patent: Jan. 9, 2007

(54) FUEL INJECTOR ASSEMBLY AND POPPET

(75) Inventor: Jordi J. Catasus-Servia, Williamsburg, VA (US)

(73) Assignee: Synerject, LLC, Newport News, VA (US)

( * ) Notice: Subject to any disclaimer, the term of this patent is extended or adjusted under 35 U.S.C. 154(b) by 57 days.

(21) Appl. No.: 11/009,035

(22) Filed: Dec. 13, 2004

(65) Prior Publication Data

US 2006/0124771 A1 Jun. 15, 2006

(51) Int. Cl.

| | |
|---|---|
| ***F02M 61/08*** | (2006.01) |
| ***F02M 51/00*** | (2006.01) |
| ***F02M 61/04*** | (2006.01) |
| ***F02M 61/00*** | (2006.01) |

(52) U.S. Cl. ..... 239/533.7; 239/585.1; 239/585.4; 239/585.5

(58) Field of Classification Search ..... 239/533.7, 239/585.1, 585.4, 585.5, 533.2, 533.3, 533.9, 239/533.11, 533.12; 123/531, 472; 251/129.15
See application file for complete search history.

(56) References Cited

U.S. PATENT DOCUMENTS

| | | | |
|---|---|---|---|
| 2,627,259 A | 2/1953 | Wood et al. | |
| 3,773,265 A | 11/1973 | Kent | |
| 4,075,999 A | 2/1978 | Danis | |
| 4,212,602 A | 7/1980 | Buran et al. | |
| 4,552,311 A | 11/1985 | Casey | |
| 4,714,198 A | 12/1987 | Savkar | |
| 4,867,116 A | 9/1989 | De Freitas Couto Rosa et al. | |
| 4,871,434 A | 10/1989 | Munz et al. | |
| 4,934,329 A | 6/1990 | Lear et al. | |
| 5,040,501 A | 8/1991 | Lemelson | |
| 5,048,497 A * | 9/1991 | Kishida et al. | 123/533 |
| 5,069,189 A | 12/1991 | Saito | |
| 5,123,399 A | 6/1992 | Motoyama et al. | |
| 5,173,339 A | 12/1992 | Singer | |
| 5,226,975 A | 7/1993 | Denton et al. | |
| 5,271,823 A | 12/1993 | Schachameyer et al. | |
| 5,358,181 A | 10/1994 | Tani et al. | |
| 5,627,258 A | 5/1997 | Takayama et al. | |
| 5,819,774 A | 10/1998 | Beardsley et al. | |
| 5,888,316 A | 3/1999 | Erickson | |
| 5,904,125 A | 5/1999 | Enright et al. | |
| 5,937,520 A | 8/1999 | Earhart et al. | |
| 5,983,865 A | 11/1999 | Yamashita et al. | |
| 5,996,227 A | 12/1999 | Reiter et al. | |

(Continued)

FOREIGN PATENT DOCUMENTS

| | | |
|---|---|---|
| CH | 296115 | 4/1954 |

(Continued)

OTHER PUBLICATIONS

Advertisement: *Armoloy of Western PA., Inc.*, Apr. 1, 2002, 4 pages, http://www.armoloy-wpa.com.

(Continued)

*Primary Examiner*—David A. Scherbel
*Assistant Examiner*—Darren Gorman
(74) *Attorney, Agent, or Firm*—Cooley Godward Kronish LLP

(57) ABSTRACT

An assembly for a fuel injector includes a fluid transportation member having a first portion that defines an internal passageway configured to convey fluid through the first portion, and a second portion in fluid communication with the first portion. The second portion defines at least one conduict configured to communicate fluid from the internal passageway out of the fluid trasnsportation memeber and a structural reinforcement portion is colocated with the second portion. A housing is configured to receive at least a portion of the transpotation member.

34 Claims, 19 Drawing Sheets

U.S. PATENT DOCUMENTS

| | | | | |
|---|---|---|---|---|
| 6,062,499 | A | 5/2000 | Nakamura et al. | |
| RE36,768 | E | 7/2000 | Lear et al. | |
| 6,145,763 | A | 11/2000 | Fleming et al. | |
| 6,209,806 | B1 | 4/2001 | Pace et al. | |
| 6,302,337 | B1 | 10/2001 | Kimmel | |
| 6,311,901 | B1 | 11/2001 | Imoehl et al. | |
| 6,402,057 | B1 * | 6/2002 | Kimmel et al. | 239/408 |
| 6,444,167 | B1 | 9/2002 | Shimodaira et al. | |
| 6,484,700 | B1 | 11/2002 | Kimmel et al. | |
| 6,508,416 | B1 * | 1/2003 | Mastro et al. | 239/585.1 |
| 6,561,167 | B1 | 5/2003 | Berndt | |
| 6,755,360 | B1 * | 6/2004 | Anderson et al. | 239/585.1 |
| 6,764,028 | B1 * | 7/2004 | Mills et al. | 239/533.7 |
| 2004/0035954 | A1 | 2/2004 | Carlise et al. | |

FOREIGN PATENT DOCUMENTS

| | | | |
|---|---|---|---|
| DE | 841080 | | 6/1952 |
| EP | 0384473 | A1 | 8/1990 |
| EP | 0404336 | A1 | 12/1990 |
| EP | 0404357 | A2 | 12/1990 |
| EP | 0494468 | | 7/1992 |
| EP | 0818622 | B1 | 11/2000 |
| EP | 1239148 | A2 | 9/2002 |
| WO | WO 87/00583 | A1 | 1/1987 |

OTHER PUBLICATIONS

Balzers, *Coating Offerings*, Apr. 1, 2002, 4 pages, http://www.btc.balzers.com/pages/coating.html.

Kolene SBN, *Salt Bath Nitriding Processes*, Apr. 1, 2002, 1 page, http://www.finishing.com/kolene/nitriding.html.

International Search Report dated May 5, 2006 for International Application No. PCT/US05/44481, 3 pages.

* cited by examiner

FUEL INJECTOR ASSEMBLY AND POPPET

BACKGROUND

The present invention relates to fuel injectors, and more particularly to an assembly and poppet for use in fuel injectors.

Conventinal fuel injectors are configured to deliver a quantity of fuel to a combustion cylinder of an engine. To increase combustion efficiency and decrease pollutants, it is desirable to atomize the delivered fuel. Generally speaking, atomization fo fuel can be achieved by supplying high pressure fuel to conventional fuel injectors, or by atomizing low pressure fuel with pressurized gas, i.e., "air assist fuel injection."

A conventional air assist fuel injector receives a metered quantity of low pressure fuel from a conventional fuel injector (not illustrated) and pressurized air from a rail (not illustrated). The air assist fuel injector atomizes the low pressure fuel with the pressurized air as it conveys the air and fuel mixture to the combustion chamber of an engine.

The pressurized air from the rail and the metered quantity of fuel from the conventional fuel injector enter the air assist fuel injector through a cap, which delivers the fuel and air to a conduit of an armature. Thereafter, the fuel and air travel through a passageway of a fluid transportation member or poppet, and exit the poppet through small slots near the end or head of the poppet. The poppet is typically attached to the armature, which is actuated by energizing a solenoid coil. When the solenoid coil is energized, the armature will overcome the force of a spring and move. Because the poppet is attached to the armature, the head of the poppet will lift off a seat when the armature is actuated so that the metered quantity of fuel is atomized as it is delivered to the combustion chamber of the engine. Hence, besides conveying liquid fuel and air, the poppet repeatedly opens to inject fuel and closes to define a seal that prevents the injection of fuel. Because of this function, the poppet is a critical component of most fuel injectors and is typically fabricated from a high strength, tough, and wear resistant material, such as AISI 440 stainless steel. For example, the conventional poppet is typically formed from stainless steel bar stock by: (1) machining the bar stock to a cylindrical blank; (2) gun-drilling the internal cylindrical passageway of the poppet; (3) heat treating the part; (4) grinding the exterior surface of the poppet; and (5) electrical discharge machining ("EDM") the slots. Unfortunately, it was discovered that the intersection between the gun-drilling of the internal passageway and the formation of the slots in the poppet via the EDM process produces stress concentration areas. These stress concentration areas, in conjunction with the micro-cracks typically resulting from the EDM process, have caused the poppet to fail at or near the slots. Additionally, it is difficult to bore the internal and elongated passageway of the poppet and there are reported failures due to excessive run-out during this operation. Despite these problems, the above-described manufacturing process was thought to be the only suitable method of manufacturing the poppet, largely because the shape, features, and requirements of conventional poppets are not well-suited for other, traditional fabrication processes.

SUMMARY

An assembly for a fuel injector includes a fluid transportation member having a first portion defining an internal passageway configured to convey fluid through the first portion, and a second portion in fluid communication with the first portion. The second portion defines at least one conduit configured to communicate fluid from the internal passageway out of the fluid transportation member, and a structural reinforcement portion is colocated with the second portion. A housing is configured to receive at least a portion of the fluid transportation member.

Other advantages and features associated with the embodiments of the present invention will become more readily apparent to those skilled in the art from the following detailed description. As will be realized, the invention is capable of other and different embodiments, and its several details are capable of modification in various obvious aspects, all without departing from the invention. Accordingly, the drawings in the description are to be regarded as illustrative in nature, and not limitative.

BRIEF DESCRIPTIONS OF THE DRAWINGS

DETAILED DESCRIPTION

Figure 1:
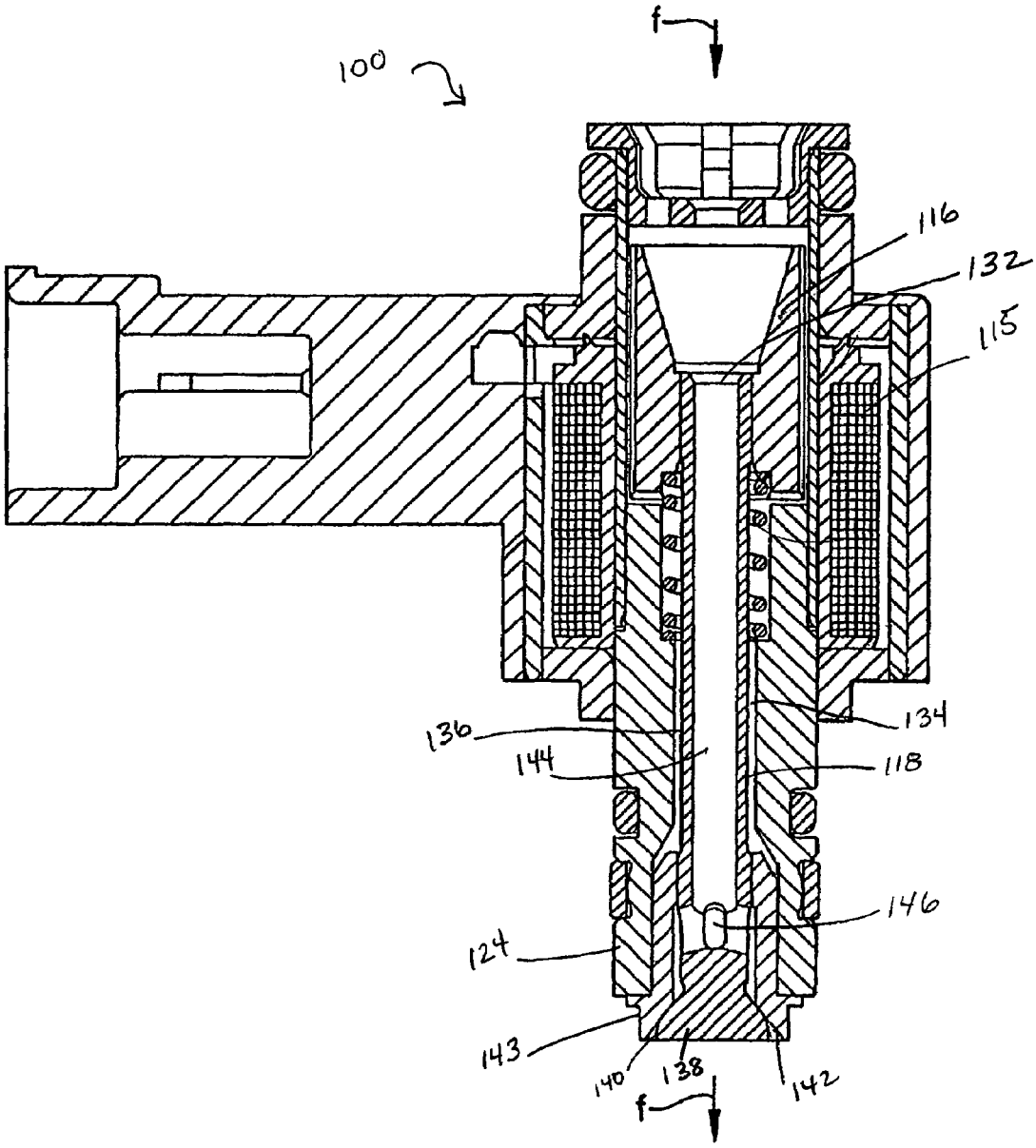
FIG. 1 is a cross-sectional view of an air assist fuel injector according to one embodiment of the invention.

FIG. 1 generally illustrates an air assist fuel injector 100 incorporating one embodiment of the invention. The air assist fuel injector 100 is configured to utilize pressurized gas to atomize low pressure liquid fuel, which together travel through the air assist fuel injector along a direction of flow f as indicated in FIG. 1. In some embodiments, the air assist fuel injector 100 is configured for use with a two-stroke internal combustion engine. When installed in an engine, the air assist fuel injector 100 is located such that the atomized low pressure fuel that exits the injector 100 is delivered to the internal combustion chamber of an engine. For example, the injector 100 may be located in a cavity of a two-stroke internal combustion engine head such that the fuel injector delivers a metered quantity of atomized liquid fuel to the combustion cylinder of the two-stroke internal combustion engine where it is ignited by a spark plug or otherwise. In alternative embodiments the air assist fuel injector is configured for operation with other engines and other applications. For example, the air assist fuel injector 100 may be configured for operation with a four stroke internal combustion engine or a rotary engine and may inject liquids other than fuel.

In some embodiments, the air assist fuel injector 100 is located adjacent a conventional fuel injector (not illustrated), which delivers metered quantities of fuel to the air assist fuel injector. The conventional fuel injector may be located in the cavity of a rail or within a cavity in the head of an engine. The air assist fuel injector 100 is referred to as "air assist" because it preferably utilizes pressurized air to atomize liquid fuel. Although it is preferred that the air assist fuel injector 100 atomize liquid gasoline with pressurized air, it will be appreciated that the air assist fuel injector 100 may atomize many other liquids with any variety of gases. For example, the air assist fuel injector 100 may atomize oil, water, kerosene, or liquid methane with pressurized gaseous oxygen, propane, or exhaust gas. Hence, the term "air assist fuel injector" is a term of art, and as used herein is not intended to dictate that the air assist fuel injector 100 be used only with pressurized air and only with liquid fuel.

The air assist fuel injector 100 shown in FIG. 1 includes a housing 124, a poppet 118 attached to an armature 116, and a seat member 143. Seat member 143 may be a separate component as shown or alternatively, may be formed integrally with housing 124. Because poppet 118 is attached to armature 116, poppet 118 will move with armature 116 when armature 116 is actuated by an energized solenoid coil 115. Poppet 118 shown in FIG. 1 is a member that opens and closes to control the discharge of fuel from the fuel injector 100. Poppet 118 includes a head 138, a stem 136, and an internal passageway 144 that extends from an inlet 132 to an outlet or conduit 146 located upstream of head 138. Poppet 118 is also received within housing 124. When poppet 118 opens and closes, it reciprocates within a channel 134 of housing 124. Head 138 includes a sealing surface 140 that abuts an impact surface 142 of seat member 143 when the fuel injector is closed. When the fuel injector is open, sealing surface 140 is spaced away from the impact surface 142 as poppet 118 is moved in a direction with the flow of fluid. In another embodiment, the poppet 118 is an inwardly opening poppet. That is, to discharge the fuel from the fuel injector, the poppet and armature move opposite the direction of flow f such that the poppet head 138 lifts inwardly off of seat 143 to discharge fuel from the air assist fuel injector.

Figure 4:
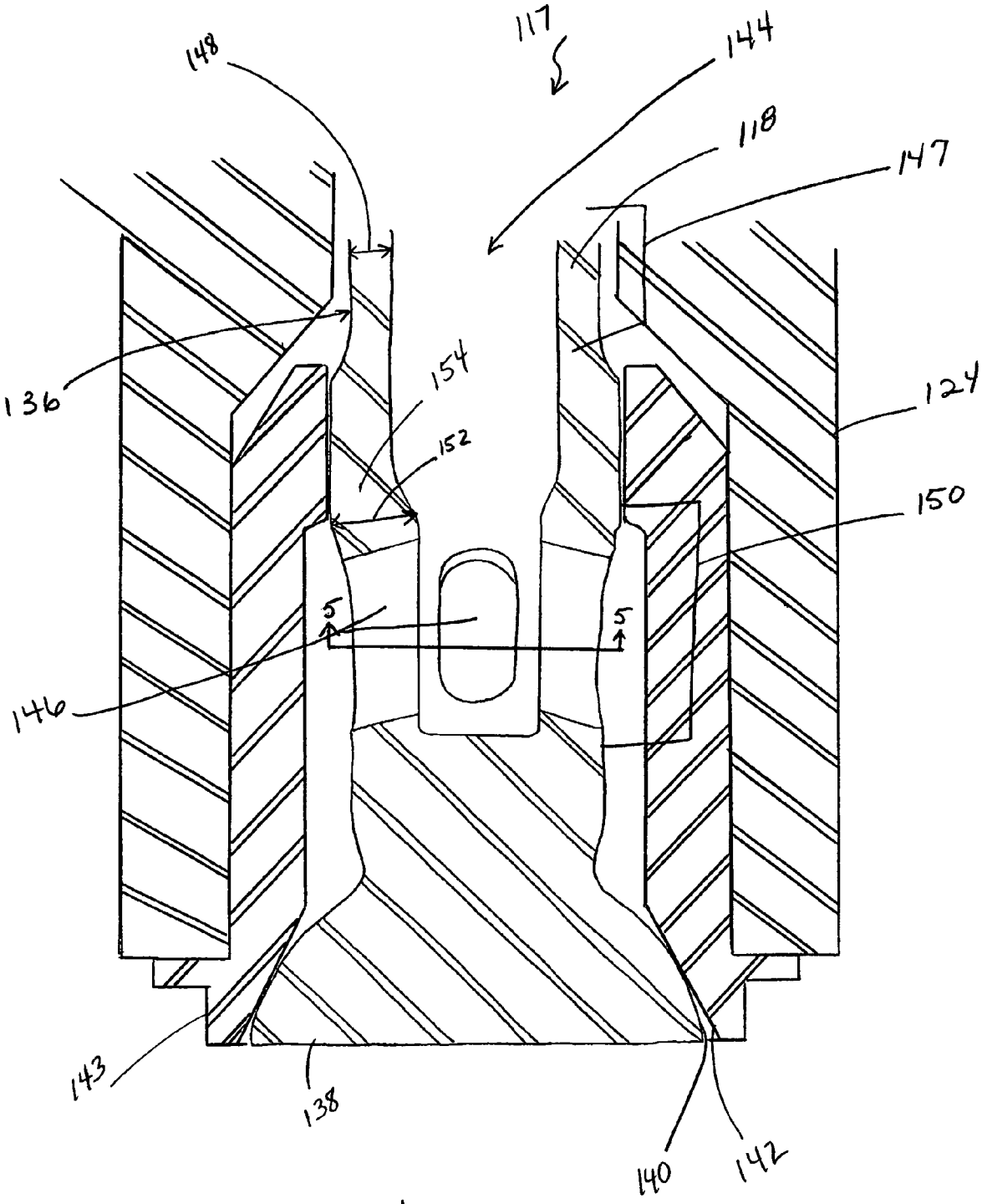
FIG. 4 is a cross-sectional view of a portion of an assembly for an air assist fuel injector according to one embodiment of the invention.

A cross-sectional view of a portion of an assembly 117 for an air assist fuel injector is shown in FIG. 4. Assembly 117 includes a fluid transportation member or poppet 118 received within a housing 124, and a seat member 143. Assembly 117 and/or poppet 118 may be incorporated in a typical air assist fuel injector such as the one described above.

Poppet 118 includes an improved structural configuration and may be manufactured utilizing a number of different processes. These processes were previously thought to be an unsuitable method of manufacturing a poppet, largely because of the shape, features, and requirements of conventional poppets. Such processes include casting, molding, metal injection molding (MIM), cold heading, cold forging and powdered metal processing, all of which are known processes available in the art. For example, a MIM process, which uses machinery similar to plastic injection molding, can be used to mold a poppet blank. The MIM process involves molding a poppet blank from a powdered metal mix that includes a binder. After molding, the binder is removed from the poppet blank through a heating/melt process. The poppet blank then undergoes a sintering, heat treating and grinding process. Poppet 118 may be fabricated from a variety of different metallic materials such as iron, aluminum, titanium, and their alloys, as well as austenitic, ferretic, or martensitic stainless steel and 400 series stainless steel.

Figure 2A:
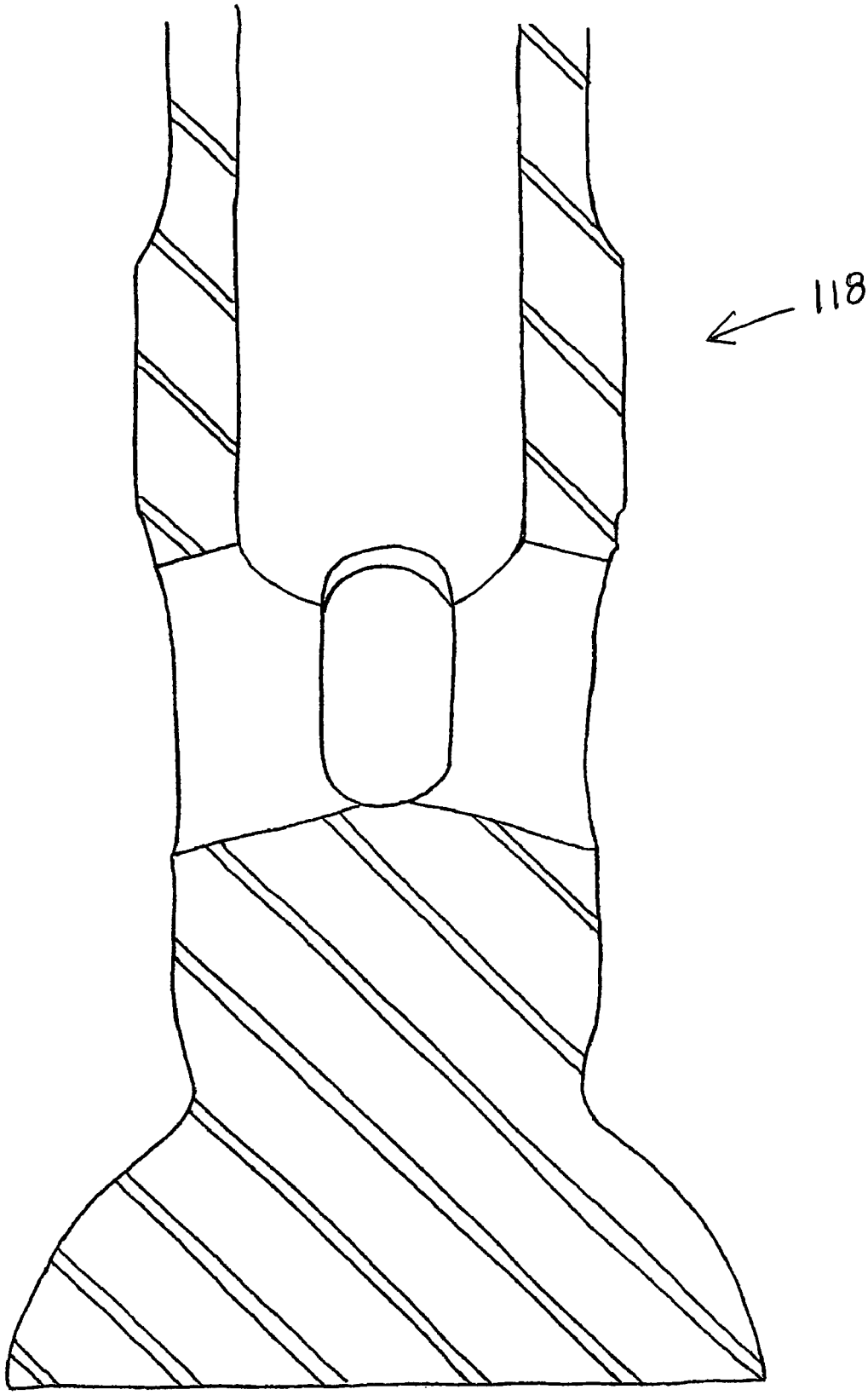
FIG. 2A is cross-sectional view of a portion of a fluid transportation member according to one embodiment of the invention.
Figure 2B:
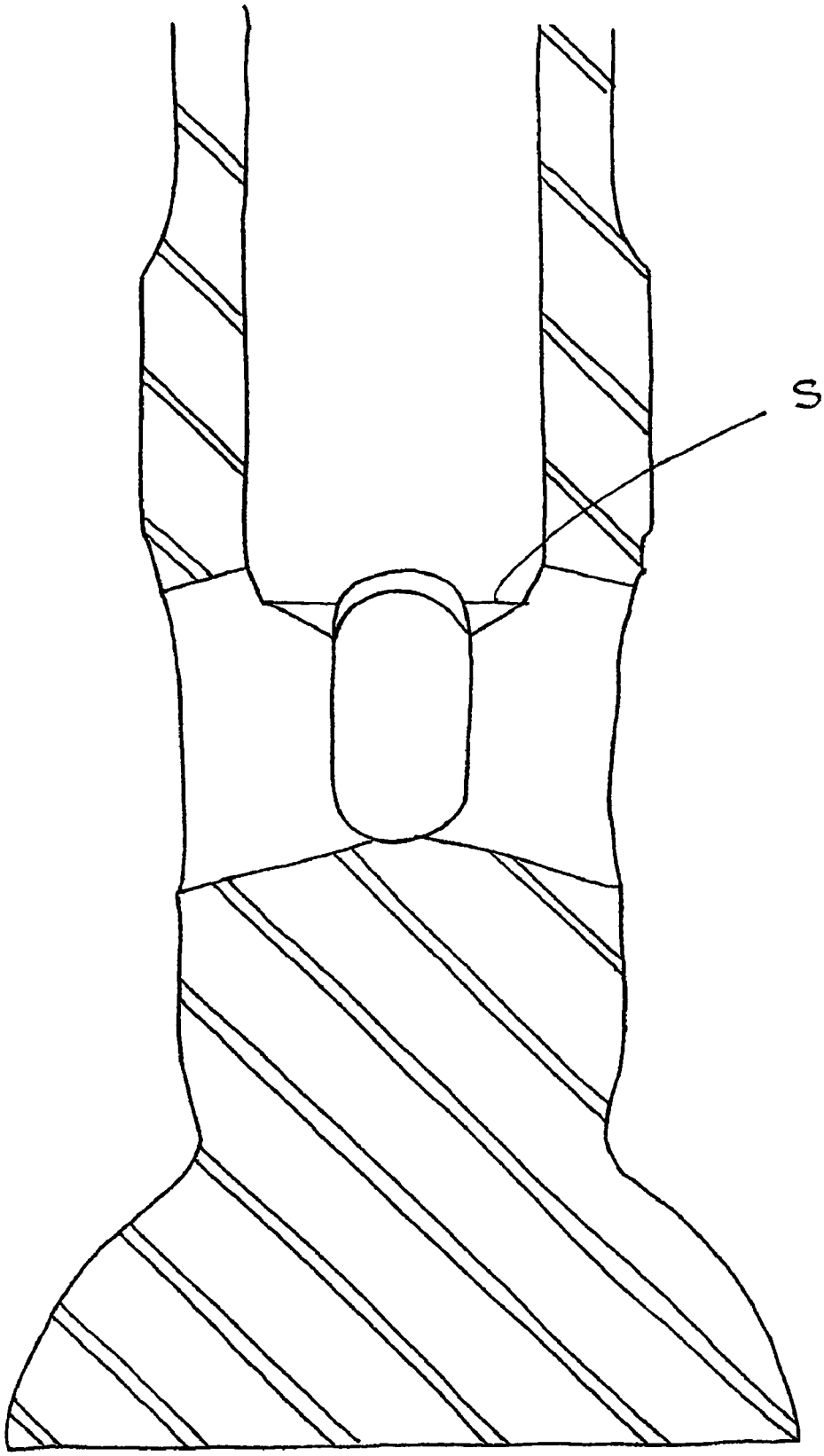
FIG. 2B is cross-sectional view of a portion of a drilled fluid transportation member.
Figure 3:
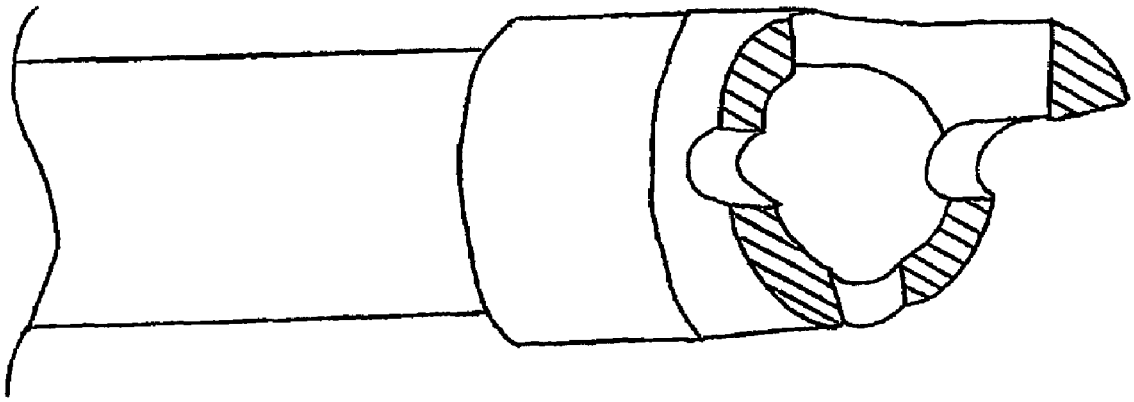
FIG. 3 is a perspective view of a portion of a transportation member illustrating a failure mode.
Figure 5:
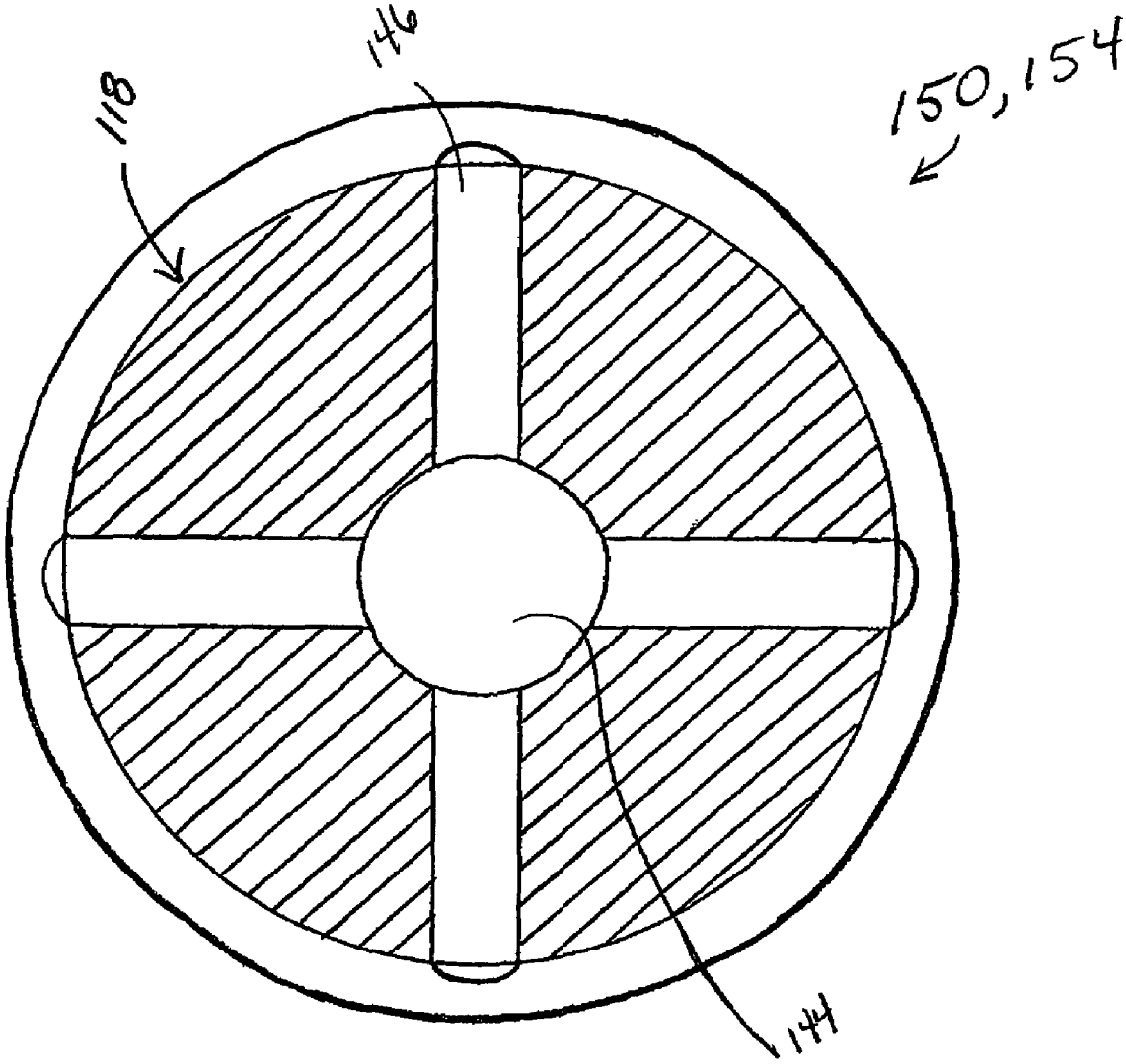
FIG. 5 is a cross-sectional view taken along line 5—5 in FIG. 4.

The portion of an assembly 117 shown in FIG. 4 is a cross-sectional view taken along a line cut longitudinally through the center of an assembly 117. FIG. 5 illustrates a cross-sectional view of a portion of the poppet 118 shown in FIG. 4 taken along a line cut laterally through a portion of the outlets 146 of poppet 118 and pointing in a direction opposite the flow f. As illustrated in FIGS. 4 and 5, poppet 118 includes a first portion 147 having a first wall thickness 148 and a second portion 150 having a second wall thickness 152. The first portion 147 includes at least a portion of the stem 136 of poppet 118. In some embodiments, second wall thickness 152 is larger than first wall thickness 148 and includes a structural reinforcement portion 154 colocated with second wall thickness 152. Processes used to manufacture poppet 118 enable the formation of multiple wall thicknesses along poppet 118 such as the larger wall thickness 152 of second portion 150. In addition, the interior surface of a poppet 118 is devoid of tool marks and sharp edges, as shown in FIG. 2A. In comparison, a poppet configured and manufactured with conventional designs and methods can contain sharp transition edges S as a result of the gundrill process to bore the internal passageway of the poppet as shown in FIG. 2B. Sharp edges such as those shown in FIG. 2B are a primary cause of failures in conventional poppets, as a fracture typically occurs in this location between the outlets. An illustration of an example poppet that has failed due to the presence of sharp edges and associated fatigue points/weaknesses is shown in FIG. 3.

In the embodiment shown in FIG. 4, the second portion 150 and the first portion 147 are in fluid communication with one another in that fluid flows through internal passageway 144 of poppet 118 and passes through first portion 147 and second portion 150. At least one outlet or conduit 146 is located on poppet 118 within second portion 150. Conduit(s) 146 permits the fluid to exit from poppet 118 when the solenoid 116 is activated and poppet 118 is moved to an open position. The embodiment shown in FIG. 4 illustrates poppet 118 with second portion 150 having four conduits 146 (three of which are visible in FIG. 4). In this embodiment, second portion 150 and structural reinforcement portion 154 include a cross-sectional perimeter having a substantially constant wall thickness and substantially circular shape, as shown in FIG. 5.

Figure 6:
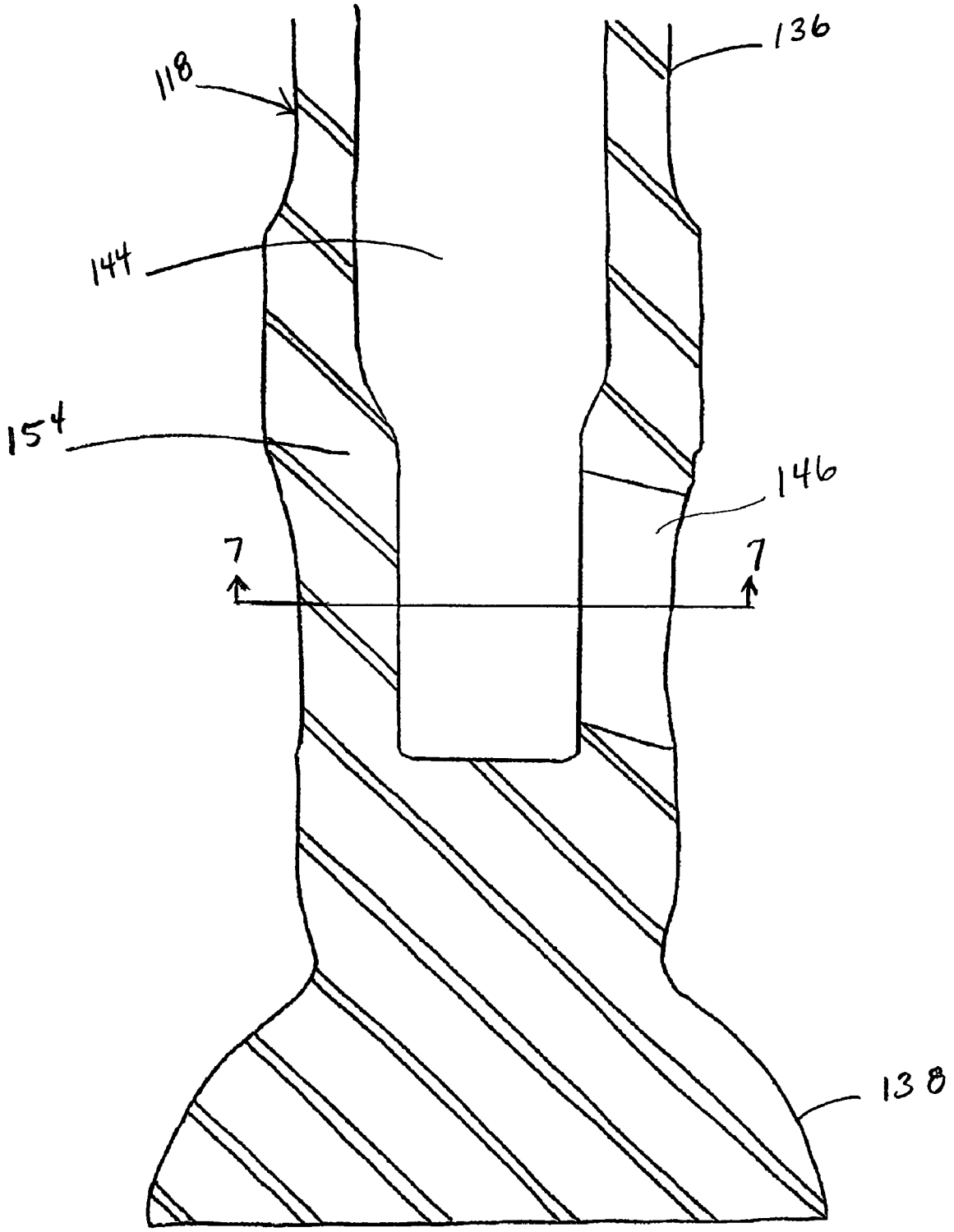
FIG. 6 is a cross-sectional view of a portion of a fluid transportation member according to one embodiment of the invention.
Figure 7:
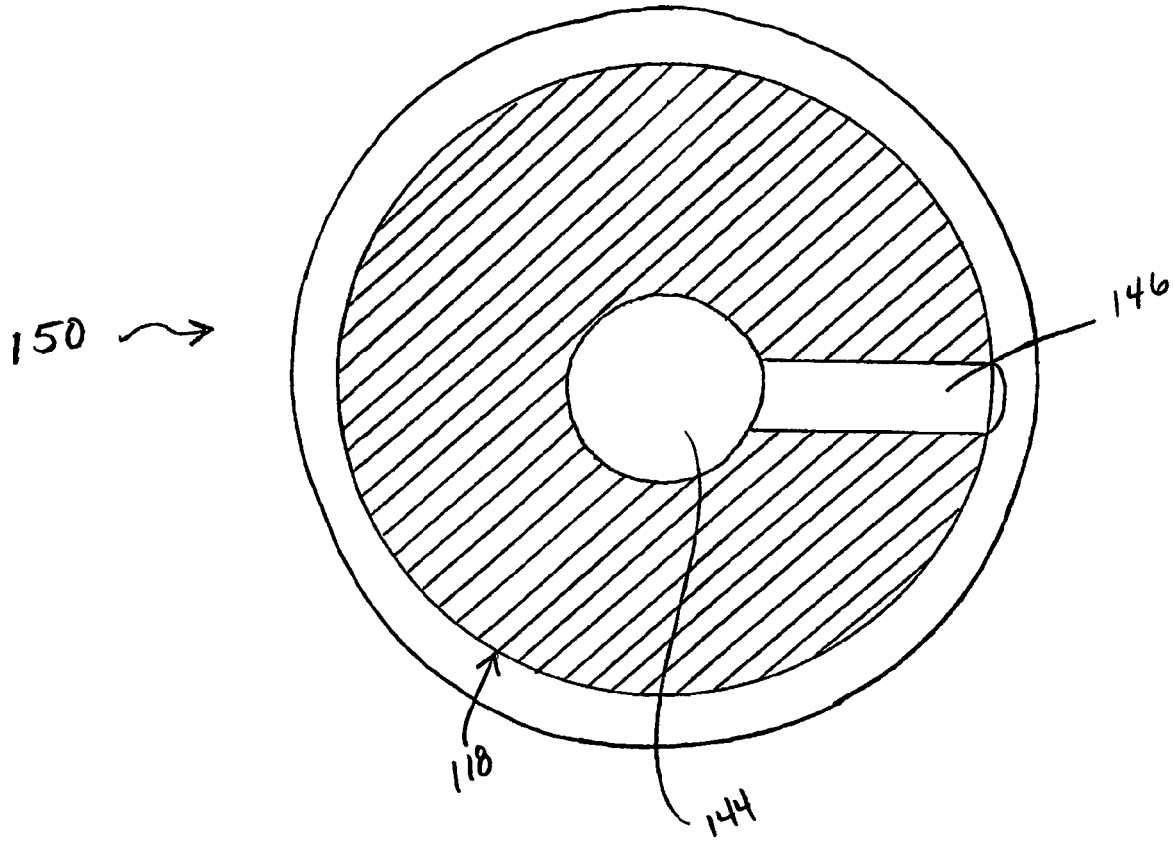
FIG. 7 is a cross-sectional view taken along line 7—7 in FIG. 6.

In alternative embodiments, poppet 118 may be configured with one or more conduits 146, and a variety of different wall thicknesses and shapes. For example, as illustrated in FIGS. 6 and 7, second portion 150 includes a cross-sectional perimeter and reinforcement portion 154 having a constant wall thickness, but with only a single conduit 146. FIG. 6 illustrates a cross-sectional view of a portion of a poppet 118 taken along a line cut longitudinally through the center of poppet 118, and FIG. 7 illustrates a cross-sectional view of a portion of the poppet 118 taken along a line cut laterally through a portion of the outlets 146 of poppet 118 and pointing in a direction opposite the flow f.

Figure 8:
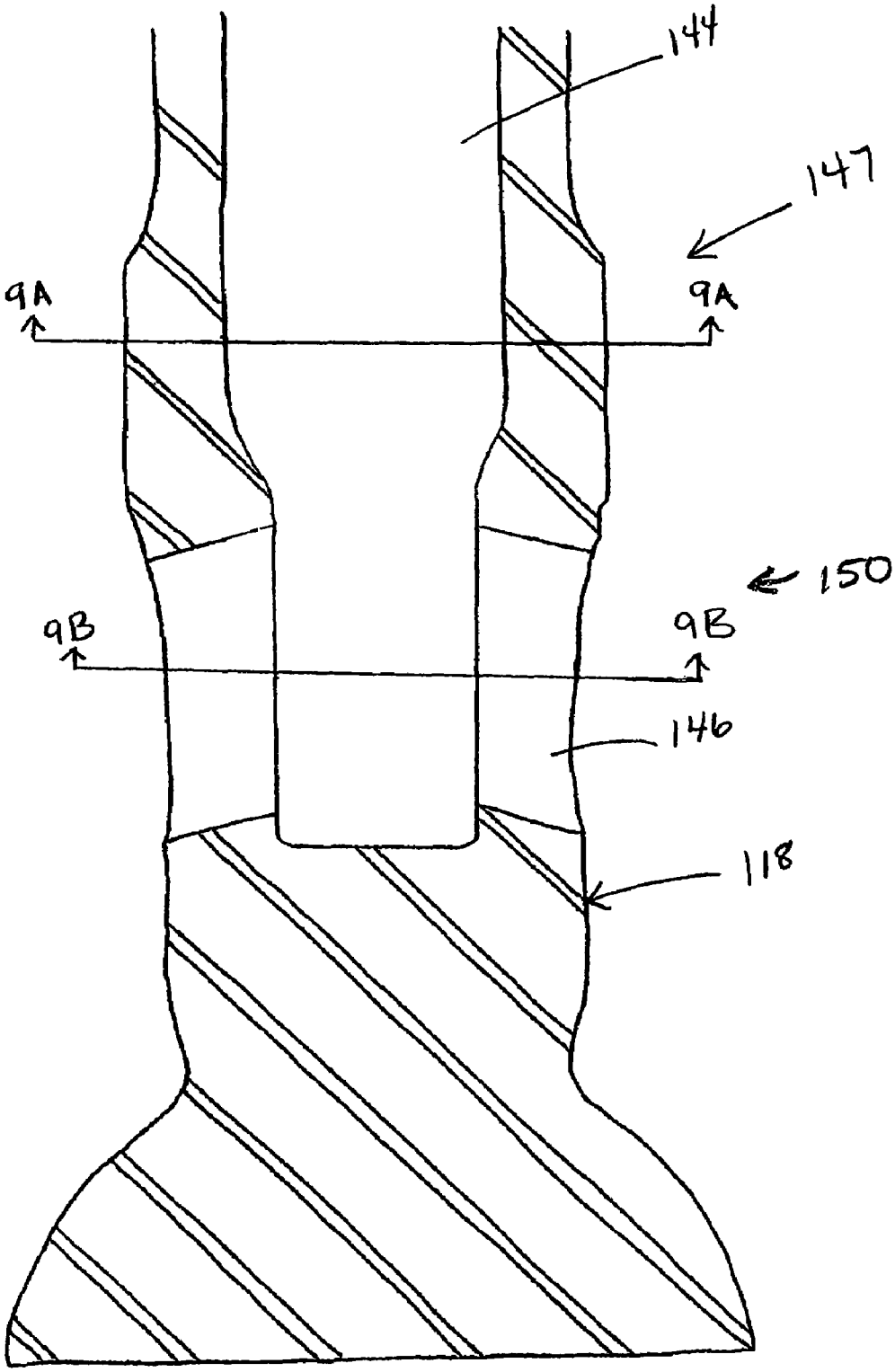
FIG. 8 is a cross-sectional view of a portion of a fluid transportation member according to one embodiment of the invention.
Figure 9A:
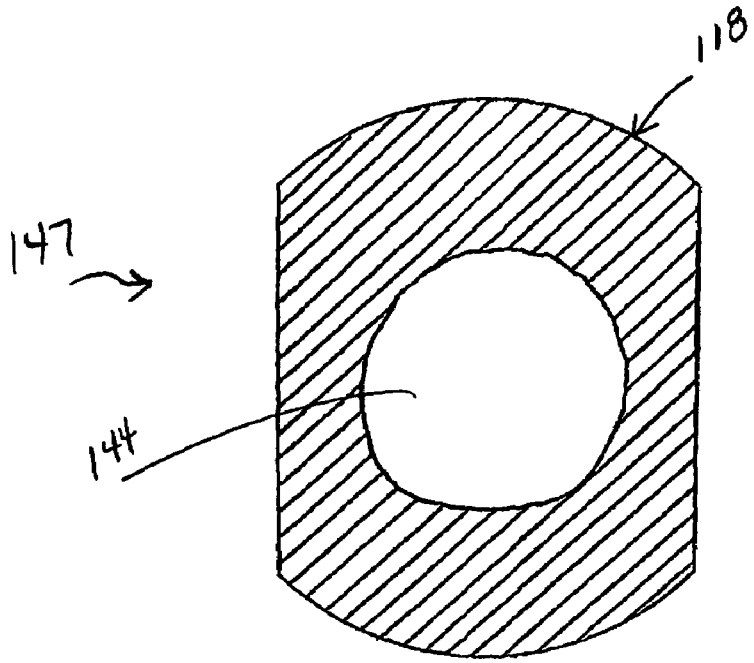
FIGS. 9A and 9B are each cross-sectional views taken along line 9A—9A and 9B—9B respectively in FIG. 8.
Figure 9B:
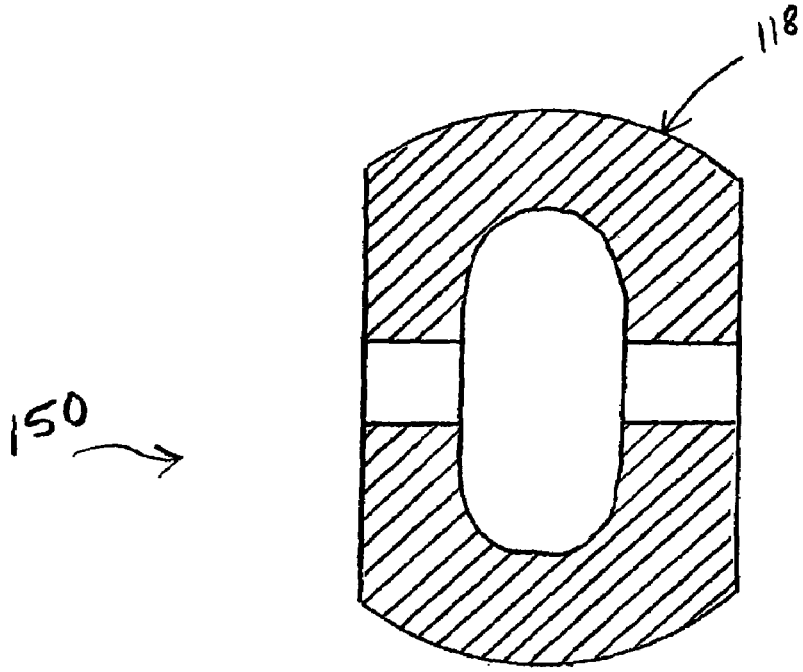

FIG. 8 illustrates a cross-sectional view of a portion of a poppet 118 taken along a line cut longitudinally through the center of a poppet 118, and FIGS. 9A and 9B illustrate a cross-sectional view of a portion of the poppet 118 taken along lines cut laterally through the poppet 118 and pointing in a direction opposite the flow f. FIG. 9B is a view from a line cut laterally through a portion of the outlets 146 and FIG. 9A is a view from a line cut laterally through first portion 147. FIGS. 8, 9A and 9B illustrate an embodiment with a first portion 147 having a non-circular cross-sectional perimeter and varying wall thickness (FIG. 9A) and a second portion 150 having a non-circular cross-sectional perimeter, two conduits 146 and a non-circular structural reinforcement portion 154 with varying wall thicknesses (FIG. 9B). Internal passageway 144 may be a variety of different shapes and sizes and may vary in size and shape along the length of poppet 118.

Figure 10:
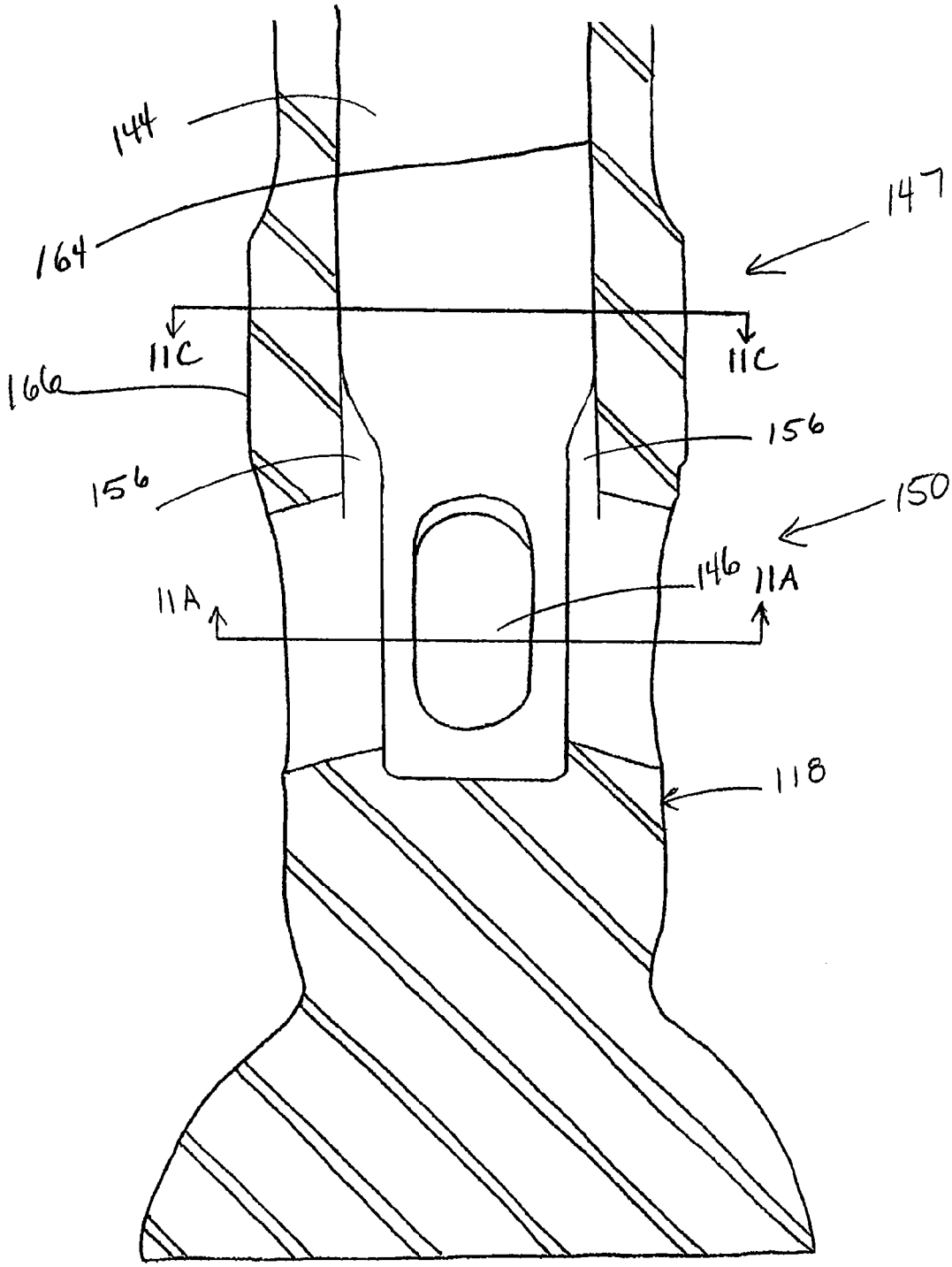
FIG. 10 is a cross-sectional view of a portion of a fluid transportation member according to one embodiment of the invention.
Figure 11A:
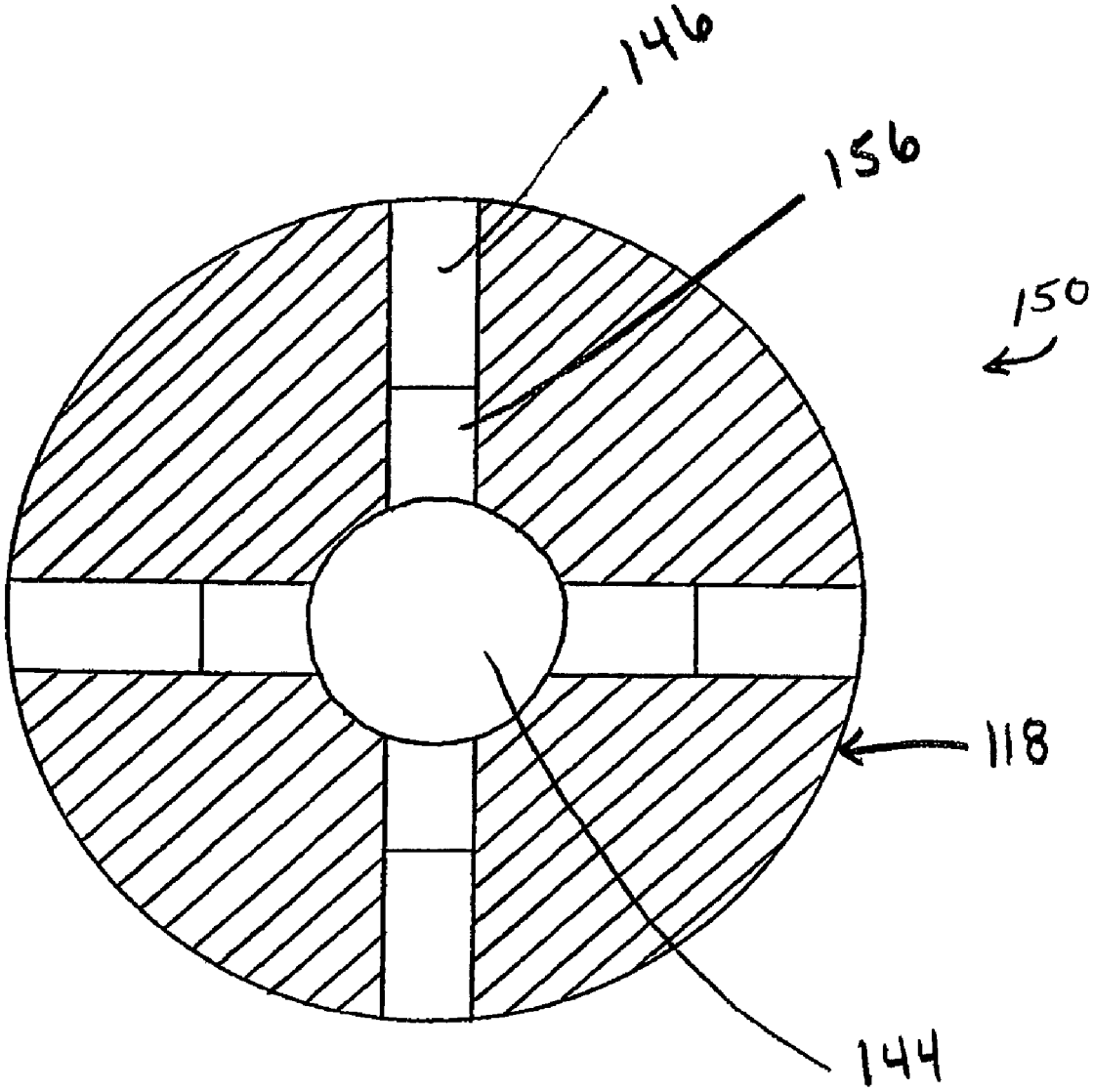
FIG. 11A is a cross-sectional view taken along lines 11A—11A in FIG. 10.
Figure 11B:
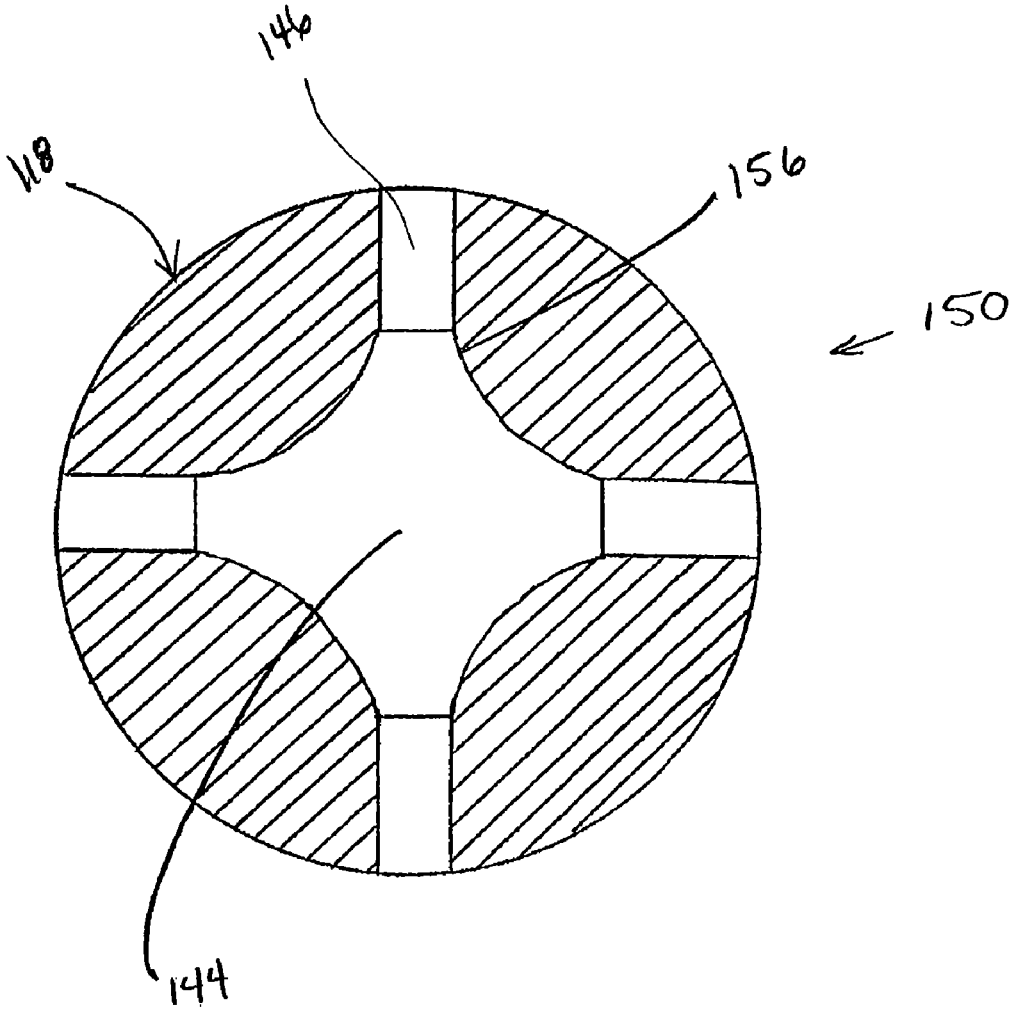
FIG. 11B is a cross-sectional view of an optional embodiment of a poppet according to the invention.
Figure 11C:
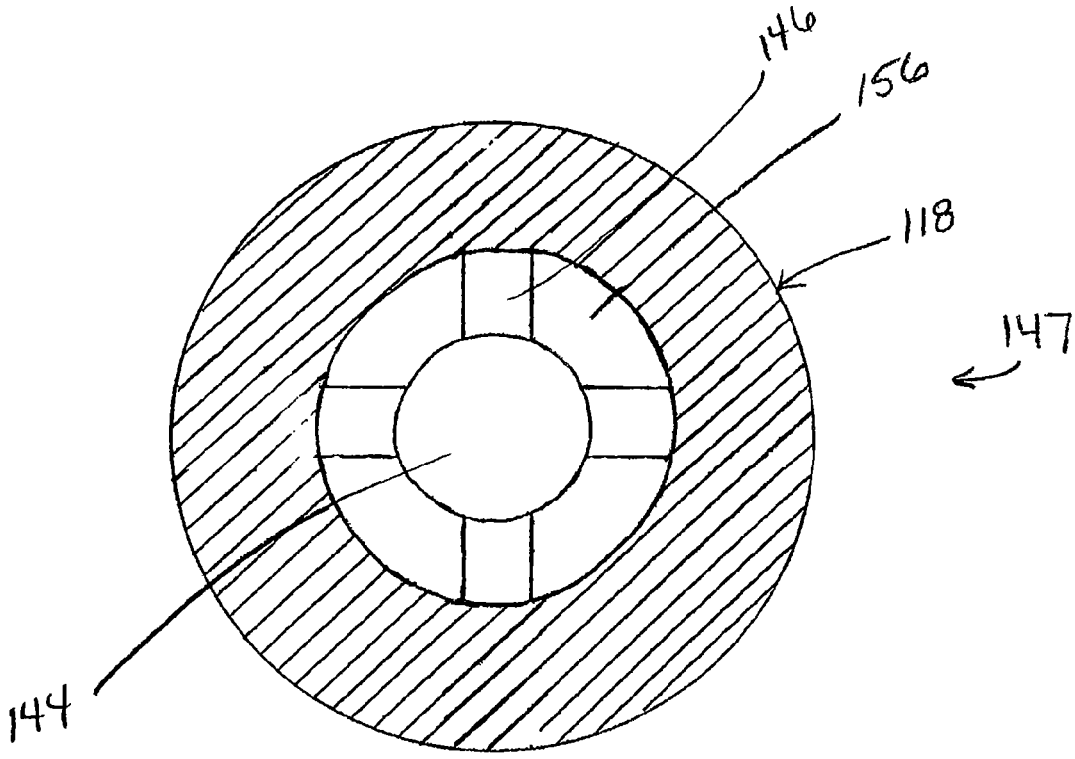
FIG. 11C is a cross-sectional view taken along line 11C—11C in FIG. 10.

Structural reinforcement portion 154 may also include at least one buttress 156 formed on either an interior surface or exterior surface of poppet 118. Buttress(es) 156 may be formed by a number of different processes such as casting, molding, metal injection molding, cold heading, cold forging, and powdered metal processing. FIG. 10 is a cross-sectional view of a portion of a poppet 118 taken along a line cut longitudinally through the center of poppet 118 and illustrates a poppet 118 having four buttresses 156 (two of which are illustrated) disposed between adjacent conduits 146 on interior surface 164 of poppet 118. FIG. 11A is a cross-sectional view of poppet 118 taken along a line cut laterally through a portion of the outlets 146 of poppet 118 and pointing in a direction opposite the flow f. FIG. 11A illustrates the second portion 150 having a cross-sectional perimeter with a substantially constant wall thickness. FIG. 11B illustrates a cross-sectional perimeter of a second portion 150 of an optional embodiment of a poppet 118 taken along a line cut laterally through a portion of outlets 146 of a poppet 118 having a non-constant wall thickness. FIG. 11C illustrates a cross-sectional perimeter of the first portion 147 with a substantially constant wall thickness.

Figure 12:
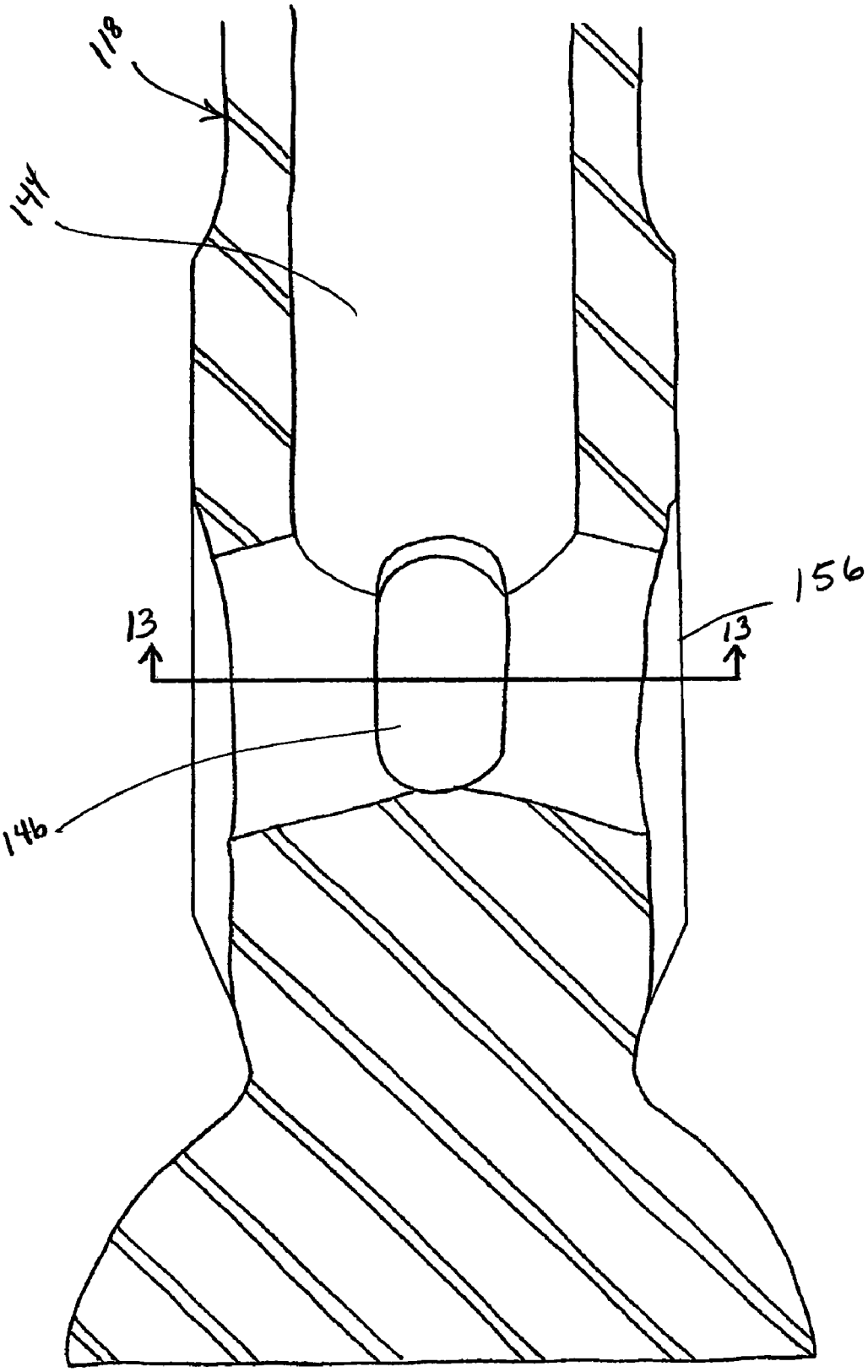
FIG. 12 is a cross-sectional view of a portion of a fluid transportation member according to one embodiment of the invention.
Figure 13:
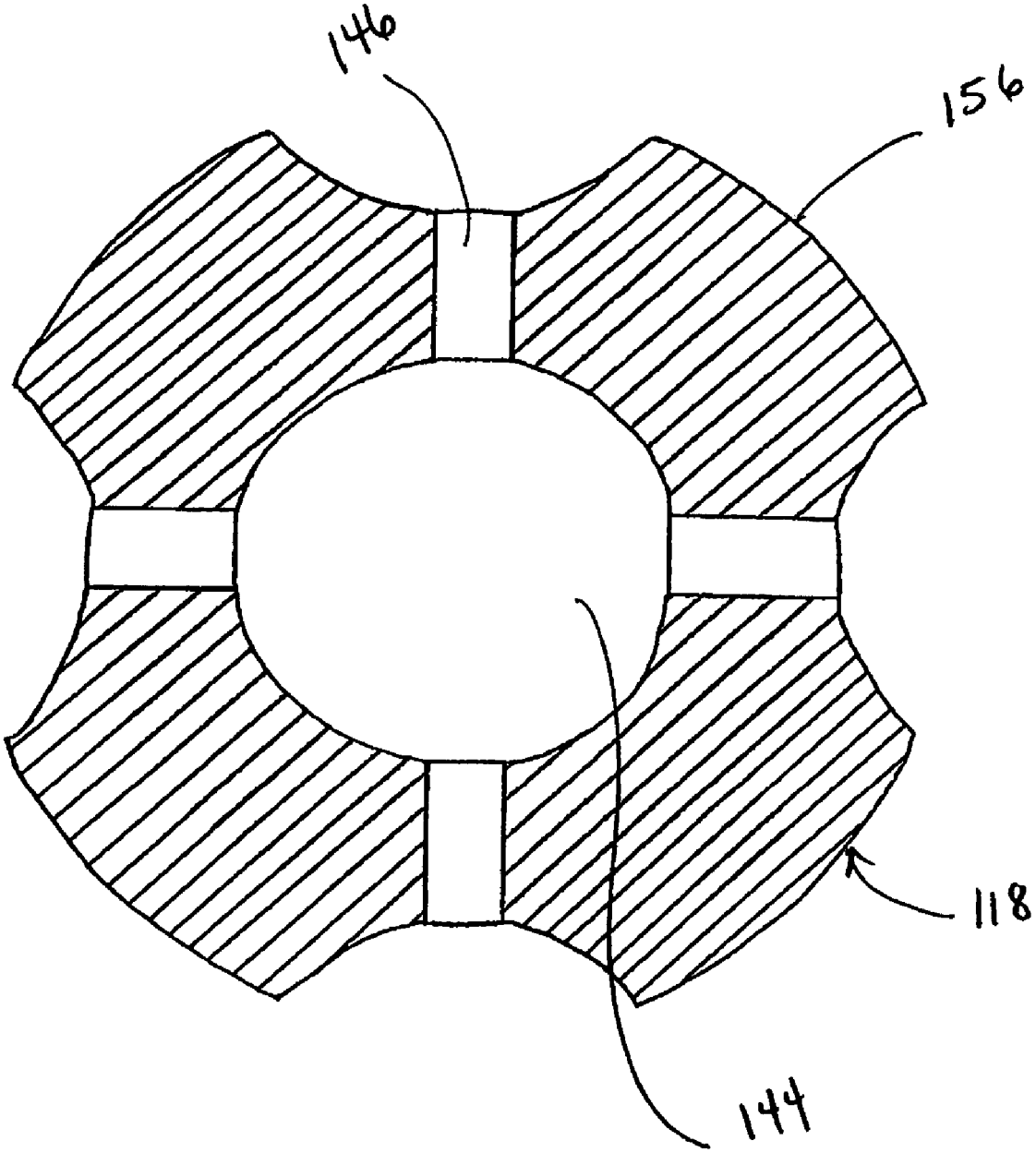
FIG. 13 is a cross-sectional view taken along line 13—13 in FIG. 12.
Figure 14:
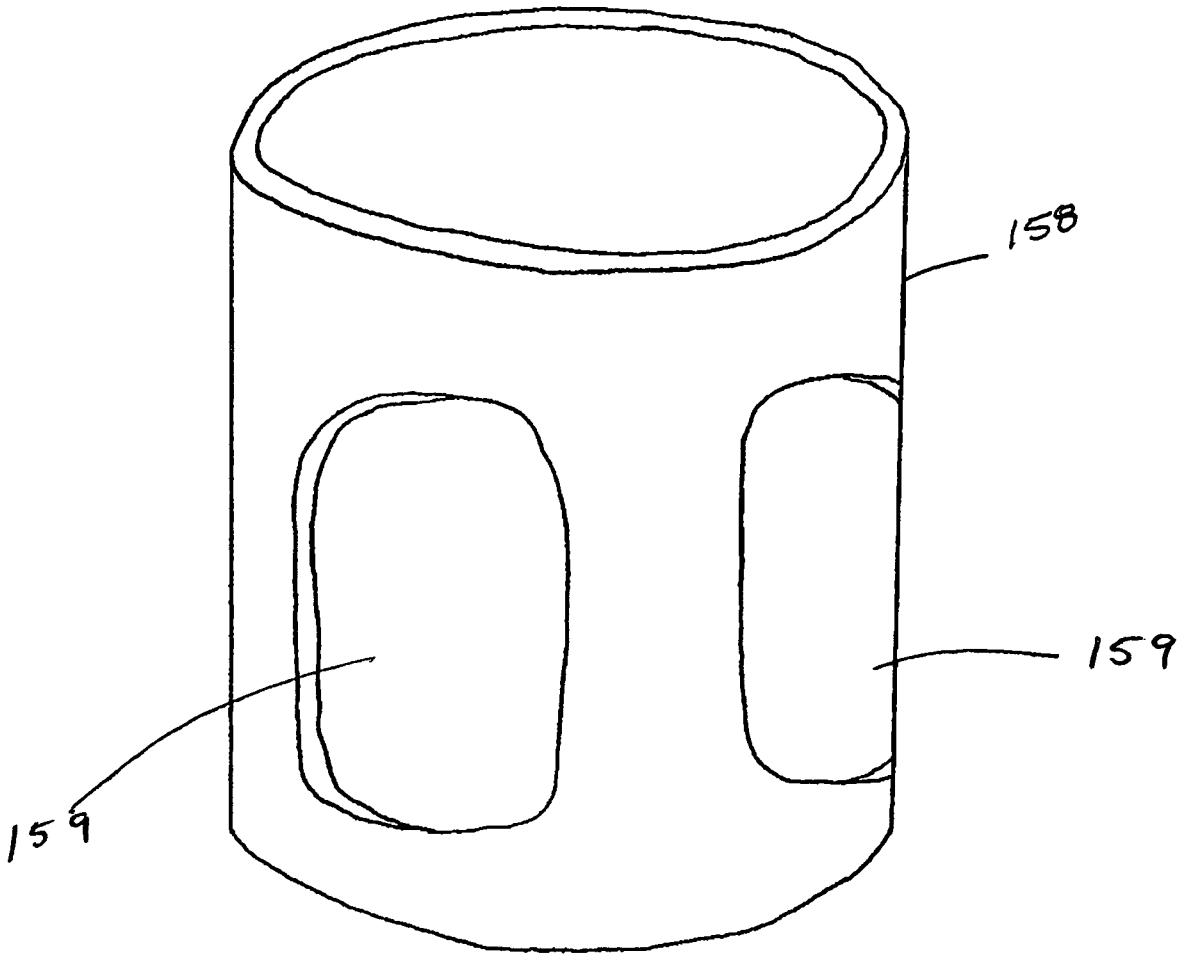
FIG. 14 is a perspective view of a reinforcement insert according to one embodiment of the invention.

A variety of buttress configurations, shapes and sizes may be incorporated, including positioning the buttresses 156 on the outer surface of poppet 118 as shown in FIGS. 12 and 13. FIG. 12 illustrates a cross-sectional view of a portion of a poppet 118 taken along a line cut longitudinally through a center of poppet 118, and FIG. 13 illustrates a cross-sectional view of a portion of the poppet 118 taken along a line cut laterally through the outlets 146 of poppet 118 and pointing in a direction opposite the flow f In this embodiment of poppet 118, the cross-sectional perimeter includes a non-constant or variable wall thickness, but it is to be understood that a constant wall thickness may also be utilized.

Figure 15:
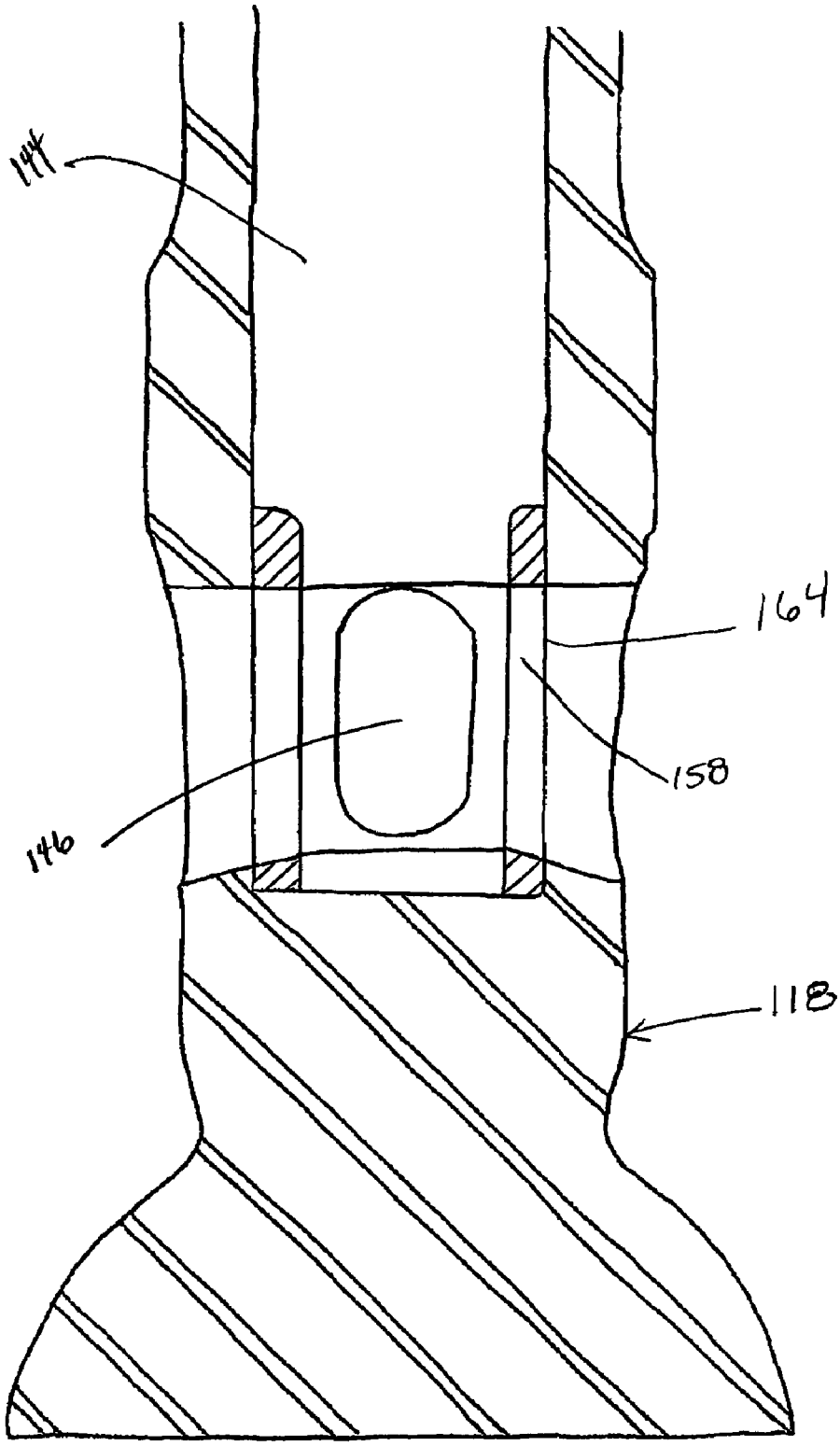
FIG. 15 is a cross-sectional view of a portion of a fluid transportation member according to one embodiment of the invention including a reinforcement insert.
Figure 16:
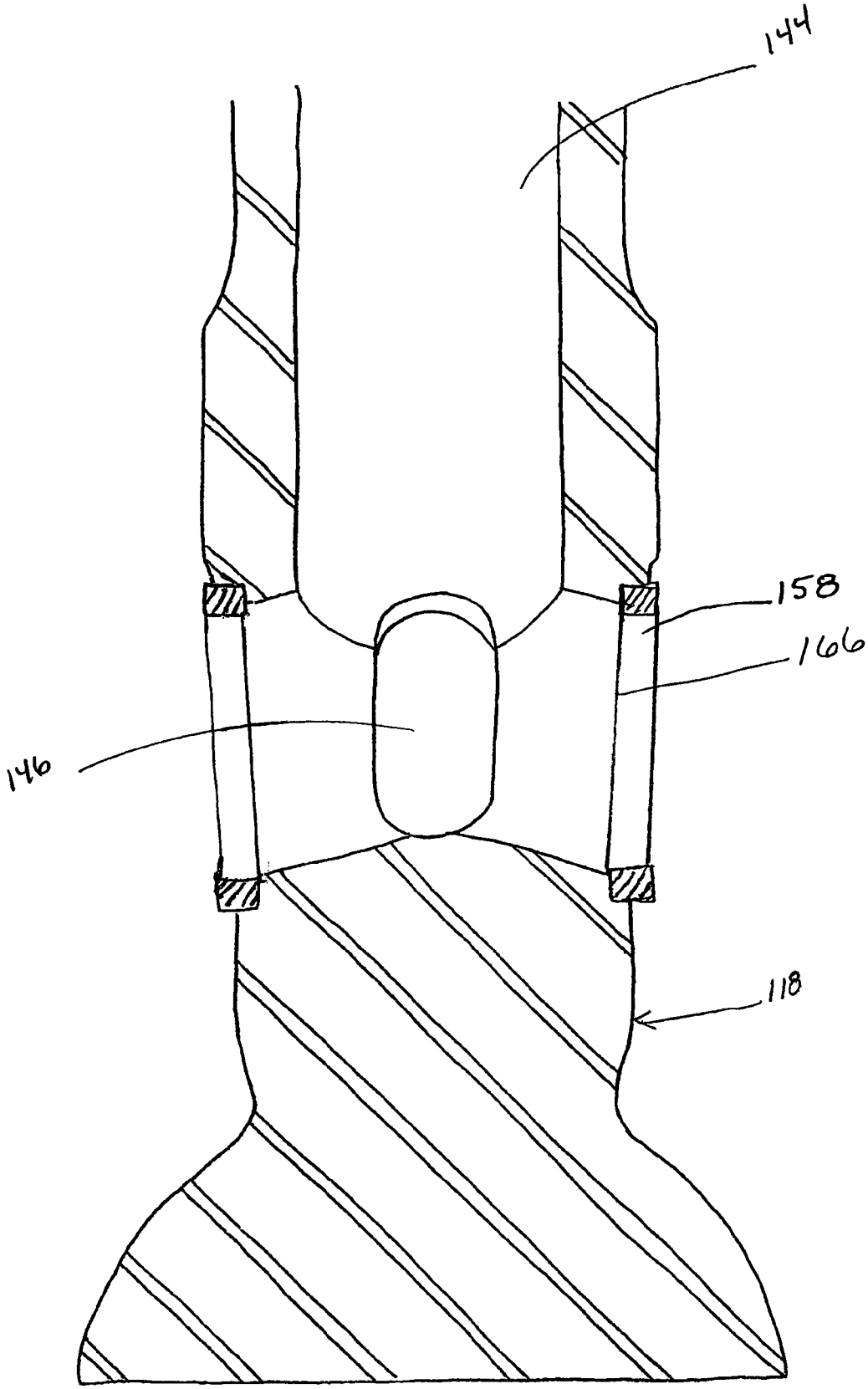
FIG. 16 is a cross-sectional view of a portion of a fluid transportation member according to one embodiment of the invention including a reinforcement insert.

In another embodiment of the invention, a reinforcement member 158 may be coupled to second portion 150 to further reinforce second portion 150. Reinforcement member 158 may be used alone or in combination with reinforcement portion 154. It includes apertures or openings 159 arranged to align with outlets 146 when reinforcement member 158 is operatively coupled to poppet 118. Reinforcement member 158, may be coupled to second portion 150 on an interior surface 164 of poppet 118, as shown in FIG. 15. The coupling may be accomplished by a variety of known attachment methods such as welding, friction fit or threaded fasteners. Alternatively, reinforcement member 158 may be configured to couple to second portion 150 on an exterior surface 166 of poppet 118, as shown in FIG. 16. Reinforcement member 158 may be fabricated from a metallic material, such as iron, aluminum, titanium, and their alloys, ferretic, as well as austenitic or martensitic stainless steel. Reinforcement member 158 provides further reinforcement and strength to poppet 118 to further eliminate product failures.

The fluid transportation members described above and other poppets fabricated as described herein may be used with fuel injectors with differing constructions where fuel is discharged in the form of a plume, including inwardly and outwardly opening fuel injectors where fuel alone is injected and where fuel is entrained in a gas, such as air.

The principles, embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes, and equivalents that fall within the spirit and scope of the present invention as defined in the claims be embraced thereby.

The invention claimed is:

1. An assembly for a fuel injector, comprising:

a fluid transportation member having a first portion defining an internal passageway configured to convey fluid through said first portion, a second portion in fluid communication with said first portion, said second portion defining at least one conduit configured to communicate fluid from said internal passageway out of said fluid transportation member, and a structural reinforcement portion colocated with said second portion and disposed within an interior portion of said fluid transportation member; and a housing configured to receive at least a portion of said fluid transportation member.

2. The assembly of claim 1, wherein said fluid transportation member is configured to move relative to said housing.

3. The assembly of claim 1, wherein said fluid transportation member is a poppet configured to move linearly along a longitudinal axis of said assembly.

4. The assembly of claim 1, wherein said fluid transportation member is an outwardly opening poppet.

5. The assembly of claim 1, wherein said second portion has a cross-sectional perimeter, said cross-sectional perimeter being of a non-circular shape.

6. The assembly of claim 1, wherein said fluid transportation member has a first wall thickness associated with said first portion, and a second wall thickness associated with said second portion, said second wall thickness being greater than said first wall thickness, and said structural reinforcement portion being associated with said second wall thickness.

7. The assembly of claim 6, wherein said second portion has a cross-sectional perimeter, said second wall thickness being substantially constant about said cross-sectional perimeter.

8. The assembly of claim 1, wherein said at least one conduit is one conduit from a plurality of conduits, each of which is configured to communicate fluid from said internal passageway out of said fluid transportation member, and said structural reinforcement portion includes a plurality of buttresses, each of said plurality of buttresses being disposed between adjacent ones of said plurality of conduits.

9. The assembly of claim 8, wherein said plurality of buttresses are formed by one of casting, molding, metal injection molding, cold heading, cold forging, and powdered metal processing.

10. The assembly of claim 1, wherein said fluid transportation member is constructed from a metallic material.

11. The assembly of claim 1, wherein at least a portion of said internal passageway is devoid of substantially sharp edges.

12. The assembly of claim 11, wherein said at least a portion of said internal passageway is defined within said second portion.

13. The assembly of claim 1, wherein at least a portion of said internal passageway is devoid of tooling marks.

14. The assembly of claim 13, wherein said at least a portion of said internal passageway is defined within said second portion.

15. An assembly for a fuel injector, comprising:

a fluid transportation member having a first portion defining an internal passageway configured to convey fluid through said first portion, a second portion in fluid communication with said first portion defining at least one conduit configured to communicate fluid from said internal passageway out of said fluid transportation member, said second portion having a cross-sectional perimeter and a wall thickness that is substantially variable about said cross-sectional perimeter;

a structural reinforcement portion defining at least one aperture at least partially aligned with said at least one conduit; and a housing configured to receive at least a portion of said fluid transportation member.

16. The assembly of claim 15, wherein said fluid transportation member is configured to move relative to said housing.

17. The assembly of claim 15, wherein said fluid transportation member is a poppet configured to move linearly along a longitudinal axis of said assembly.

18. The assembly of claim 15, wherein said fluid transportation member is an outwardly opening poppet.

19. The assembly of claim 15, wherein said at least one conduit is one conduit from a plurality of conduits, each of which is configured to communicate fluid from said internal passageway out of said fluid transportation member.

20. The assembly of claim 15, wherein at least a portion of said internal passageway is devoid of substantially sharp edges.

21. The assembly of claim 20, wherein said at least a portion of said internal passageway is defined within said second portion.

22. An assembly for a fuel injector, comprising:

a fluid transportation member having a first portion defining an internal passageway configured to convey fluid through said first portion, and a second portion in fluid communication with said first portion, said second portion defining at least one conduit configured to communicate fluid from said internal passageway out of said fluid transportation member;

a reinforcement member coupled to said second portion by at least one of welding, interference fit, mechanical fastener, or crimping; and a housing configured to receive at least a portion of said fluid transportation member.

23. The assembly of claim 22, wherein said fluid transportation member is configured to move relative to said housing member.

24. The assembly of claim 22, wherein said fluid transportation member is a poppet configured to move linearly along a longitudinal axis of said assembly.

25. The assembly of claim 22, wherein said fluid transportation member is an outwardly opening poppet.

26. The assembly of claim 22, wherein said reinforcement member is configured to be located adjacent to said at least one conduit.

27. The assembly of claim 22, wherein said reinforcement member is configured to be coupled to an exterior surface of said fuel transportation member adjacent to said at least one conduit.

28. The assembly of claim 22, wherein said reinforcement member is configured to be coupled to an interior surface within said internal passageway.

29. A fluid transportation member, comprising:

a first portion defining an internal passageway configured to convey a fluid through said first portion, a second portion in fluid communication with said first portion, said second portion defining a plurality of conduits each configured to communicate the fluid from said internal passageway out of said fluid transportation member, and a structural reinforcement portion including a plurality of buttresses, each of said plurality of buttresses being disposed between adjacent ones of said plurality of conduits.

30. The fluid transportation member of claim 29, having a first wall thickness associated with said first portion, and a second wall thickness associated with the second portion, said second wall thickness being greater than said first wall thickness, and said structural reinforcement portion being associated with said second wall thickness.

31. The fluid transportation member of claim 30, wherein said second portion has a cross-sectional perimeter, said second wall thickness being substantially constant about said cross-sectional perimeter.

32. The fluid transportation member of claim 29, wherein said plurality of buttresses are formed by one of casting, molding, metal injection molding, cold heading, cold forging and powdered metal processing.

33. The fluid transportation member of claim 29, wherein said fluid transportation member is constructed from a metallic material.

34. An assembly for a fuel injector, comprising:

a fluid transportation member having a first portion defining an internal passageway configured to convey fluid through said first portion, and a second portion in fluid communication with said first portion, said second portion defining at least one conduit configured to communicate fluid from said internal passageway out of said fluid transportation member;

a reinforcement member coupled to an interior surface within said internal passageway, and configured to reinforce said second portion; and a housing configured to receive at least a portion of said fluid transportation member.

* * * * *